US010302253B2

(12) United States Patent
McBride

(10) Patent No.: US 10,302,253 B2
(45) Date of Patent: May 28, 2019

(54) INSULATED SPHERE, INSULATION SYSTEM THEREFORE, AND METHOD OF INSTALLING SAME

(71) Applicant: INSULTHERM, INC., La Porte, TX (US)

(72) Inventor: Jonathan McBride, La Porte, TX (US)

(73) Assignee: Insultherm, Inc., La Porte, TX (US)

( * ) Notice: Subject to any disclaimer, the term of this patent is extended or adjusted under 35 U.S.C. 154(b) by 232 days.

(21) Appl. No.: 15/617,752

(22) Filed: Jun. 8, 2017

(65) Prior Publication Data

US 2018/0202607 A1 Jul. 19, 2018

Related U.S. Application Data

(60) Provisional application No. 62/355,662, filed on Jun. 28, 2016.

(51) Int. Cl.
*F17C 1/12* (2006.01)
*B67D 1/00* (2006.01)
(Continued)

(52) U.S. Cl.
CPC ..... *F17C 1/12* (2013.01); *B67D 1/00* (2013.01); *F17C 3/04* (2013.01); *B65D 90/06* (2013.01); *F17C 2201/0128* (2013.01); *F17C 2201/054* (2013.01); *F17C 2203/0325* (2013.01); *F17C 2203/0329* (2013.01); *F17C 2203/0345* (2013.01); *F17C 2203/0358* (2013.01);
(Continued)

(58) Field of Classification Search
CPC ..... F17C 1/12; F17C 2201/0128; F17C 2203/0358; B65D 90/06
USPC ..... 220/565, 592.2, 567.2
See application file for complete search history.

(56) References Cited

U.S. PATENT DOCUMENTS 711,026 A 10/1902 Updike
1,688,868 A 10/1928 Horton
(Continued)

FOREIGN PATENT DOCUMENTS

CN 201785346 U 4/2011

OTHER PUBLICATIONS

Lieberman, N.P., "Troubleshooting Refinery Processes", PennWell Publishing (Tulsa, OK), Chapter 2, "Delayed Coking Cycles", pp. 18-39 (1981).

(Continued)

*Primary Examiner* — Stephen J Castellano
(74) *Attorney, Agent, or Firm* — Jeffrey L. Wendt; The Wendt Firm, P.C.

(57) ABSTRACT

An insulated spherical pressure vessel, such as a sphere, having an insulation system installed thereon. The insulation system includes an equatorial support including an equatorial support bar having upper and lower rods attached to upper and lower sides, and a plurality of clips perpendicular to the bar, the clips having one or more holes for additional rods. One or more insulation layers are installed and held against the sphere wall by metal bands. A cable support matrix including metal straps and horizontal cables is installed over the insulation layers, and then insulation panels are secured to the matrix cables using fasteners. The insulation panels each include insulation material and an exterior metal jacket. The panels are secured to horizontally adjacent insulation panels with standing seams. The cables are not secured to the metal straps in any way, but are allowed to freely move through belt loops of the metal straps.

19 Claims, 8 Drawing Sheets

(51) Int. Cl.
*F17C 3/04* (2006.01)
*B65D 90/06* (2006.01)

(52) U.S. Cl.
CPC ..... *F17C 2203/0643* (2013.01); *F17C 2203/0646* (2013.01); *F17C 2203/0648* (2013.01); *F17C 2209/228* (2013.01); *F17C 2260/015* (2013.01); *F17C 2260/033* (2013.01); *F17C 2260/042* (2013.01); *F17C 2270/01* (2013.01)

(56) References Cited

U.S. PATENT DOCUMENTS

| | | | |
|---|---|---|---|
| 1,757,988 | A | 5/1930 | Wilhelm |
| 2,209,420 | A | 7/1940 | Rutten et al. |
| 2,323,297 | A | 7/1943 | Collins |
| 2,501,951 | A | 3/1950 | Lintz |
| 2,561,461 | A | 7/1951 | Coleman, Jr. |
| 2,596,738 | A | 5/1952 | Thomas |
| 2,731,334 | A | 1/1956 | Wissmiller et al. |
| 2,738,094 | A | 3/1956 | Fowler |
| 2,775,594 | A | 12/1956 | Shea, Jr. |
| 2,955,686 | A | 10/1960 | Blomeley et al. |
| 3,312,028 | A | 4/1967 | Schroyer |
| 3,363,889 | A | 1/1968 | Shirley et al. |
| 3,456,835 | A | 7/1969 | Marcmann |
| 3,519,256 | A | 7/1970 | Heisterkamp |
| 3,555,758 | A | 1/1971 | Schroter |
| 3,820,292 | A | 6/1974 | Fitzpatrick |
| 3,945,236 | A | 3/1976 | Hooper |
| 3,948,412 | A | 4/1976 | Bennett |
| 4,004,394 | A | 1/1977 | Bennett |
| 4,004,429 | A | 1/1977 | Mouton, Jr. |
| 4,044,517 | A | 8/1977 | Schroter |
| 4,122,640 | A | 10/1978 | Commins et al. |
| 4,181,235 | A | 1/1980 | Baysinger |
| 4,223,797 | A | 9/1980 | Skakunov |
| 4,225,055 | A | 9/1980 | Hills et al. |
| 4,230,293 | A | 10/1980 | Hamm et al. |
| 4,338,756 | A | 7/1982 | Crothers |
| 4,347,949 | A | 9/1982 | Bennett |
| 4,442,639 | A | 4/1984 | Lindsey et al. |
| 4,534,490 | A | 8/1985 | McBride |
| 4,577,839 | A | 3/1986 | Carlson et al. |
| 4,649,680 | A | 3/1987 | Weisner |
| 5,263,603 | A | 11/1993 | McBride |
| 9,243,416 | B2 | 1/2016 | Chism et al. |

OTHER PUBLICATIONS

Lieberman, N.P., "Troubleshooting Refinery Processes", PennWell Publishing (Tulsa, OK), Chapter 3, "Delayed Coking Process", pp. 40-50 (1981).

Armatherm(TM) 500 brochure, pp. 1-2, Armadillo NV, Fairhaven, Massachusetts, (accessed on the Internet Mar. 6, 2016, downloaded from the Internet Aug. 8, 2017).

CX-1 Precision Tension Measurements, pp. 1-8, Tensitron, accessed and downloaded from the Internet Mar. 6, 2016.

Loos & Co., Inc., "7×7 MC31377 Commercial Aircraft Cable Flexible Preformed MONEL 400" Product Technical Data Sheet, accessed and downloaded from the Internet Mar. 4, 2016.

Loos & Co., Inc., "7×19 MC31379 Commercial Aircraft Cable Flexible Preformed MONEL 400" Product Technical Data Sheet, accessed and downloaded from the Internet Mar. 4, 2016.

Monel(R) Alloy 400 product brochure, pp. 1-16, Special Metals Corporation, accessed and downloaded from the Internet Mar. 4, 2016.

"Single Lock Standing Seam Panel System Installation Guide", VMZINC, May 7, 2009, available online at: http://www.vmzinc-us.com/images/vmzinc/documentations/documents/Installation_Guide_SingleLockStabdingSeam.pdf (Year: 2009).

Espacenet translation of Wu et al. (CN201785346) (Year: 2011).

Williams et al., "Flexible Aerogel Insulation for Coker- and Sulfur-Unit Applications", Coking.com, Sep. 2010, pp. 1-12, Available online at:https://refiningcommunity.com/wp-content/uploads/2017/06/Flexible-Aerogel-Insulation-for-Coker-and-Sulfur-Unit-Applications-Williams-Seipp-Aspen-Aerogels-DCU-Calgary-2010.pdf.

McBride, "Coke Drum Insulation", Coking.com, May 2011, Available online at: https://refiningcommunity.com/wp-content/uploads/2017/07/Coke-Drum-Insulation-McBride-Insultherm-DCU-Galveston-2011.pdf (Year: 2011).

USPTO Office Action dated Dec. 26, 2018 in U.S. Appl. No. 15/491,637, pp. 1-40 (Year 2018).

INSULATED SPHERE, INSULATION SYSTEM THEREFORE, AND METHOD OF INSTALLING SAME

CROSS-REFERENCE TO RELATED APPLICATIONS

The present application claims benefit of and priority to U.S. provisional patent application No. 62/355,662, filed Jun. 28, 2016, incorporated herein by reference in its entirety.

BACKGROUND INFORMATION

Technical Field

The present disclosure relates to insulated vessels, insulation systems therefore, and methods of installing same. More particularly, the present disclosure relates to insulated spherical pressure vessels ("spheres").

Background Art

As noted in U.S. Pat. No. 5,263,603, assigned to Insultherm, Inc. La Porte, Tex., in the petroleum and chemical industries, it is customary to store liquids and the like within large tank structures which are usually installed out in the open where they are exposed to the elements, both heat and cold. These storage tanks usually comprise steel or other metallic tank structures that by reason of being installed out in the open must be provided with a suitable insulating material so that the products in storage within the tanks may be kept at the desired temperatures.

Various arrangements or systems have been provided in the past for securing insulated panels to storage tanks. Representative patents in the general area of securing insulated panels to storage tanks are U.S. Pat. Nos. 2,323,297, 2,501,951, 3,546,835, 4,004,394, 4,044,517, 4,338,756, and 4,347,949. These patents deal with insulating cylindrical tanks, not spherical tanks. The arrangements disclosed in these patents have not heretofore been successfully adapted for insulating spherical tanks. See also U.S. Pat. Nos. 711,026; 1,757,988; 2,561,461; 2,596,738; 3,363,889; 3,519,256; 5,263,603; and 9,243,416.

U.S. Pat. No. 4,122,640 to Commins et al. relates to insulated tank jacketing system for cylindrical storage tanks in which cables are positioned horizontally about the tank's outer circumference. Commins et al. uses fasteners having a sleeve-shaped portion that is positioned around the cable, and a bulbous rivet-like element at one end thereof positioned between the adjoining panel sections. The panel sections include opposed beaded sections which are then crimped over the bulbous rivet-like element to secure them to the cable.

U.S. Pat. No. 4,534,490, assigned to Insultherm, Inc., La Porte, Tex., relates to an improved system for insulating storage tanks that utilizes cables arranged horizontally about the tank's outer circumference, and panels mounted exteriorly of the cables. A metal strap is wrapped around the cable and then is folded between adjoining flanges of panel sections. The system of above-mentioned U.S. Pat. No. 5,263,603, also assigned to Insultherm, Inc., includes vertical straps and horizontal cables positioned at spaced intervals along the outside of the tank structure. The straps and cables form a web, which is extensible and flexible during expansion and/or contraction of the tank. Insulating material may be applied directly against the tank interiorly of the straps and cables. Another layer of padding or insulating material may be applied exteriorly of the straps and cables. Then the panels are fastened to the web. The panels are preferably trapezoid-shaped. Metal fasteners interposed around each cable hold the panels thereto in such a manner that there is no restriction of the cable from expansion or contraction. Each panel has a channel-shaped section with substantially upstanding and opposed side flanges. The panels can vary in length and width such that the top end of each panel mates with an adjoining panel near the top of the tank, and the bottom end of each panel mates with an adjoining panel at or near the bottom of the tank.

It is undesirable and unsafe to employ welding methods to affix insulating panels directly to an existing tank, which may either contain or be in the vicinity of flammable liquids, gases or solids. In the past, spherical tanks have been insulated by first spraying or otherwise applying a layer of insulating material onto the spherical tank, then applying a mastic or other coating externally of the insulation, and/or pop-riveting panels together to provide a protective cover over the insulating material. With respect to the system of above-mentioned U.S. Pat. No. 5,263,603, the method of fastening the panels to the web with the metal fasteners, while effective in that there is no restriction of the cable from expansion or contraction, provide a direct route for conductive heat transfer to the standing seams, which can reduce efficiency of the insulation system. Moreover, the method of fastening the cables to the vertical straps requires that a polyisocyanurate or polypropylene pad be installed before the jacketing panels, otherwise the vapor barrier property may be compromised by the web punching through the jacketing.

As may be seen, there remains a need for more robust insulation panel designs, particularly for spherical pressure vessels (spheres), allowing thermal movement while having stainless steel or other metal outer shell combined with a standing seam that provides a weather proof, durable, maintenance-free sphere insulation. The insulation systems and methods of the present disclosure are directed to these needs.

SUMMARY

In accordance with the present disclosure, improved sphere insulation panel designs, insulated spheres, and methods of installation of insulation on spheres and similar shaped pressure vessels are provided that overcome some or all of the deficiencies of previous designs. A cable support matrix holds the insulation panels while allowing sphere and cable movement without damaging the insulation.

A first aspect of the disclosure is an insulated sphere comprising (or consisting essentially of, or consisting of):

a) a sphere having a sphere wall, a sphere wall exterior surface, and a sphere radius of curvature;

b) an insulation system installed on the sphere wall exterior surface, the insulation system comprising:

- i) an equatorial support comprising (or consisting essentially of, or consisting of):
  - A) a metal generally horizontal equatorial support bar (which may be composed of one or more segments) having upper and lower metal rods attached to a plurality of metal tabs that are in turn attached to respective upper and lower sides of the bar, the equatorial support bar having a radius of curvature greater than the radius of curvature of the sphere;
  - B) the equatorial support bar further comprising a plurality of metal clips extending away from a major surface of the bar, the clips each having one or more passages configured to accept one or more additional metal rods;

C) one or more bolting plates securing ends of the equatorial support bar, or corresponding ends of segments of same;

ii) one or more insulation layers held to the external surface of the sphere, each layer held by a plurality of arcuate laterally spaced metal bands each having first and second ends attached to one of the rods at opposite sides of the sphere;

iii) a cable support matrix comprising a plurality of horizontal metal tensioned cables and a plurality of arcuate laterally spaced metal straps, each of the metal straps having a plurality of arcuate latitudinally spaced loops facing away from the sphere wall external surface, each arcuate loop defining a passage therethrough, the arcuate loops corresponding in number to the plurality of cables, each of the plurality of metal cables routed through horizontally aligned arcuate loops of the arcuate laterally spaced metal straps; and iv) a plurality of insulation panels secured to the cables of the cable support matrix by a plurality of fasteners, each insulation panel comprising insulation material and an exterior metal jacket, each insulation panel positioned between horizontally adjacent insulation panels configured with standing seams.

A second aspect of the disclosure is a sphere insulation system or kit comprising (or consisting essentially of, or consisting of):

i) an equatorial support comprising (or consisting essentially of, or consisting of):

A) a metal equatorial support bar (which may be composed of one or more segments) configured to have upper and lower metal rods attached thereto, the metal rods configured to be attached to a plurality of metal tabs that are in turn configured to be attached to respective upper and lower sides of the bar, the equatorial support bar configured to have a radius of curvature greater than a radius of curvature of a sphere to be insulated, the sphere having an external surface;

B) the equatorial support bar further configured to have a plurality of metal clips extending away from a major surface of the bar, the clips each having one or more passages configured to accept one or more additional metal rods;

C) one or more bolting plates configured to secure ends of the equatorial support bar, or corresponding ends of segments of same;

ii) one or more insulation layers and a plurality of metal bands each having first and second ends, the insulation layers configured to be held to an external surface of the sphere, each layer configured to be held by some of the plurality of metal bands arcuately shaped and laterally spaced about the sphere, the metal bands each having first and second ends configured to be attached to one of the rods at opposite sides of the sphere;

iii) a cable support matrix comprising a plurality of metal cables and a plurality of metal straps, the cables and straps configured to be arcuately shaped about the sphere, each metal strap configured to have a plurality of spaced apart (preferably uniformly spaced) arcuate loops extending away from a first major surface of each metal strap, the metal straps figured to be positioned so that the arcuate loops extend away from the sphere wall external surface, each arcuate loop defining a passage therethrough configured to accept one of the cables, the arcuate loops corresponding in number at least to the plurality of cables, each of the plurality of metal cables configured to be routed through horizontally passages in arcuate loops of the arcuately shaped laterally spaced metal straps; and iv) a plurality of insulation panels configured to be secured to the cables by a plurality of fasteners, each insulation panel comprising insulation material and an exterior metal jacket, each insulation panel configured to be positioned between horizontally adjacent insulation panels configured with standing seams.

The systems and kits of the present disclosure may also include other features as described herein such as an equatorial flashing folded over the standing seams, and a C-channel flashing, a portion of which is inserted under the equatorial flashing, then pop riveted thereby creating a seal.

Yet another aspect of the present disclosure is a method of insulating a spherical pressure vessel having a sphere wall exterior surface (for example a spherical storage facility, spherical reactor, or other spherical pressure vessel) comprising (or consisting essentially of, or consisting of):

a) attaching an equatorial support to the sphere wall exterior surface, the equatorial support comprising (or consisting essentially of, or consisting of):

i) a metal generally horizontal equatorial support bar (which may be composed of one or more segments) having upper and lower metal rods attached to a plurality of metal tabs that are in turn attached to respective upper and lower sides of the bar, the equatorial support bar having a radius of curvature greater than the radius of curvature of the sphere;

ii) the equatorial support bar further comprising a plurality of metal clips extending away from a major surface of the bar, the clips each having one or more passages configured to accept one or more additional metal rods;

iii) one or more bolting plates securing ends of the equatorial support bar, or corresponding ends of segments of same;

b) attaching one or more insulation layers to the external surface of the sphere wall by i) placing insulation material against the sphere wall exterior surface;

ii) laterally spacing a plurality of arcuately shaped metal bands about the sphere, each having first and second ends, iii) attaching the first end to one of the rods, and iv) attaching the second end to the same rod at an opposite side of the sphere;

c) installing a cable support matrix over the one or more insulation layers of step (b), by i) placing a plurality of arcuate laterally spaced metal straps over the one or more insulation layers, the metal straps having a plurality of spaced apart arcuate loops on external surfaces of the straps facing away from the sphere wall external surface, ii) selecting a plurality of cables comprising (consisting essentially of, or consisting of) metal selected from the group consisting of stainless steel and a solid-solution alloy having a melting point range of 2370 to 2460° F. (1300 to 1350° C.) consisting essentially of (or consisting of) from 28 to 34 percent copper, a minimum of 63 percent nickel, a maximum of 2.0 percent manganese, a maximum of 2.5 percent iron, a maximum of 0.3 percent carbon, a maximum of 0.024 percent sulfur, and a maximum of 0.5 percent silicon, iii) routing the plurality of metal cables through horizontally aligned passages in horizontally aligned arcuate loops, the number of arcuate loops on each strap corresponding in number to the plurality of cables; and iv) tensioning the cables (in certain embodiments tensioning to a tension ranging from about 100 to about 500 lb, with decreasing amount in the lower end of the range for cables near the poles of the spherical pressure vessel); and d) securing a plurality of insulation panels to the cables of the cable support matrix by use of a plurality of fasteners, each insulation panel comprising insulation material and an exterior metal jacket, each insulation panel positioned between horizontally adjacent insulation panels with standing seams.

The equatorial support bar, rods, tabs, clips, bolting plates, straps, cables, and may be steel, in particular corrosion-resistant steel, or other corrosion-resistant metal. An important feature of the insulated spheres, insulation systems or kits, and methods disclosed herein is the thermal movement allowed, that is, the sphere or other similarly shaped pressure vessel is allowed to expand and contract without damage to the sphere or insulation.

These and other features of the insulated spheres, insulation systems or kits, and methods of the disclosure will become more apparent upon review of the brief description of the drawings, the detailed description, and the claims that follow. It should be understood that wherever the term "comprising" is used herein, whether describing an embodiment or a component or step of an embodiment, other alternative embodiments, components, and steps where the term "comprising" is substituted with "consisting essentially of" are explicitly disclosed herein. It should be further understood that wherever the term "comprising" is used herein, other alternative embodiments, components, and steps where the term "comprising" is substituted with "consisting of" are explicitly disclosed herein. Moreover, the use of negative limitations is specifically contemplated; for example, certain insulation support systems and methods may comprise a number of physical components and features, but may be devoid of certain optional hardware and/or other features. For example, certain systems of this disclosure are devoid of weldments welded to the sphere or pressure vessel being insulated. Further, a component may be devoid of passages, cavities, slots, and the like, in other words, may be a solid piece.

BRIEF DESCRIPTION OF THE DRAWINGS

The manner in which the objectives of this disclosure and other desirable characteristics can be obtained is explained in the following description and attached drawings in which:

It is to be noted, however, that the appended drawings of FIGS. 1-13 may not be to scale, and illustrate only typical system embodiments of this disclosure. Furthermore, FIG. 14 illustrates only one of many possible methods of this disclosure for installing insulation panels on a sphere in accordance with the present disclosure. Therefore, the drawing figures are not to be considered limiting in scope, for the disclosure may admit to other equally effective embodiments.

DETAILED DESCRIPTION

Figure 1:
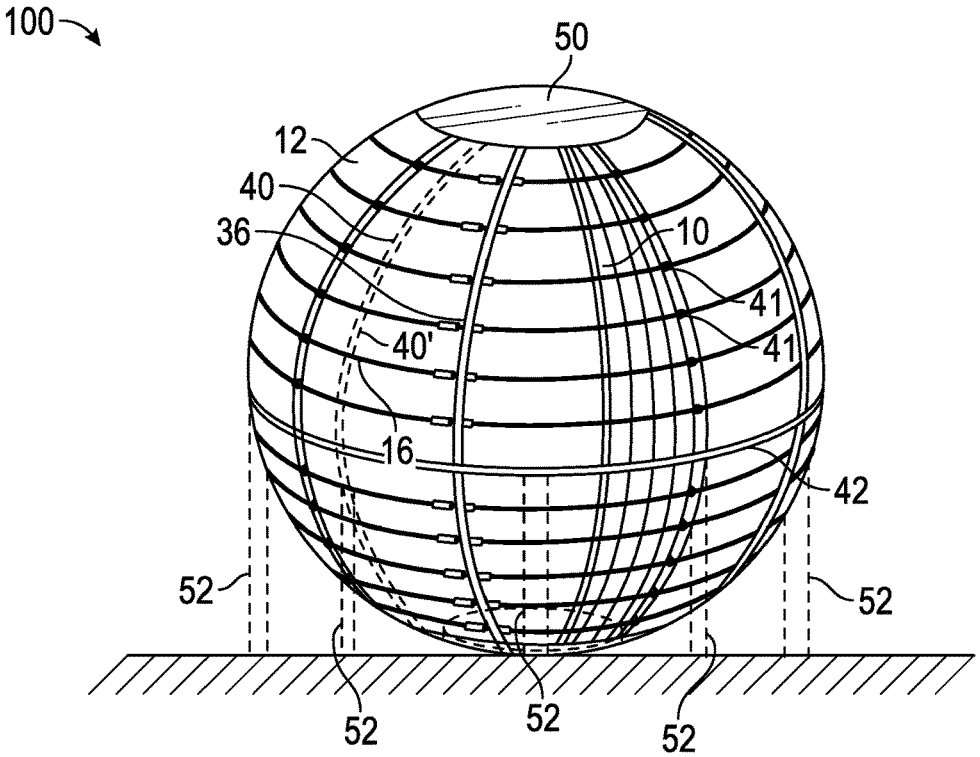
FIG. 1 is an isometric view, partially in phantom, illustrating schematically one embodiment of a spherical storage tank structure supported on legs, provided with an insulation panel system that is partially installed according to one embodiment of the present disclosure.

In the following description, numerous details are set forth to provide an understanding of the disclosed insulated spheres, insulation systems and kits, and methods. However, it will be understood by those skilled in the art that the insulated spheres, insulation systems and kits, and methods disclosed herein may be practiced without these details and that numerous variations or modifications from the described embodiments may be possible. All U.S. patent applications and U.S. Patents referenced herein are hereby explicitly incorporated herein by reference, irrespective of the page, paragraph, or section in which they are referenced. Compositions are on weight percent basis unless otherwise specified.

A first aspect of the disclosure is an insulated sphere comprising (or consisting essentially of, or consisting of):

a) a sphere having a sphere wall, a sphere wall exterior surface, and a sphere radius of curvature;

b) an insulation system installed on the sphere wall exterior surface, the insulation system comprising:

i) an equatorial support comprising (or consisting essentially of, or consisting of):

A) a metal generally horizontal equatorial support bar (which may be composed of one or more segments) having upper and lower metal rods attached to a plurality of metal tabs that are in turn attached to respective upper and lower sides of the bar, the equatorial support bar having a radius of curvature greater than the radius of curvature of the sphere;

B) the equatorial support bar further comprising a plurality of metal clips extending away from a major surface of the bar, the clips each having one or more passages configured to accept one or more additional metal rods;

C) one or more bolting plates securing ends of the equatorial support bar, or corresponding ends of segments of same;

ii) one or more insulation layers held to the external surface of the sphere, each layer held by a plurality of arcuate laterally spaced metal bands each having first and second ends attached to one of the rods at opposite sides of the sphere;

iii) a cable support matrix comprising a plurality of horizontal metal tensioned cables and a plurality of arcuate laterally spaced metal straps, each of the metal straps having a plurality of arcuate latitudinally spaced loops facing away from the sphere wall external surface, each arcuate loop defining a passage therethrough, the arcuate loops corresponding in number to the plurality of cables, each of the plurality of metal cables routed through horizontally aligned arcuate loops of the arcuate laterally spaced metal straps; and iv) a plurality of insulation panels secured to the cables of the cable support matrix by a plurality of fasteners, each insulation panel comprising insulation material and an exterior metal jacket, each insulation panel positioned between horizontally adjacent insulation panels configured with standing seams.

In certain embodiments the insulation material may be selected from the group consisting of aerogel, glass fiber, mineral fiber, cellular glass foam, polyisocyanurate foam, and combinations and composites thereof. In certain embodiments the first and second ends of the arcuate laterally spaced metal bands may be attached to one of the rods at opposite sides of the sphere by welding; in other embodiments the ends of the metal bands may be secured to the rods by folding the ends of the bands around the rods and securing the ends of the rods to itself using screws or pop rivets, as illustrating and described herein.

In certain embodiments the exterior metal jacket of the insulation panel may be selected from the group consisting of aluminum sheet, stainless steel sheet, sheets of alloys of zinc and aluminum, and combinations and composites thereof.

In certain embodiments the plurality of insulation panels may be secured to the insulation support system using a plurality of strap fasteners and/or threaded members.

In certain embodiments each of the cables may be selected from T304 stainless steel, T316 stainless steel, and a solid-solution alloy having a melting point range of 2370 to 2460° F. (1300 to 1350° C.) consisting essentially of (or consisting of) from 28 to 34 (or 29 to 34, or 30 to 34, or 31 to 34, or 32 to 34, or 28 to 33, or 28 to 32, or 28 to 31, or 28 to 30) percent copper, a minimum of 63 percent nickel (or a minimum of 64, or 65, or 66, or 67, or 68, or 69, or 70, or 75 percent nickel), a maximum of 2.0 (or 1.9, or 1.8, or 1.7, or 1.6, or 1.5, or 1.4, or 1.3, or 1.2, or 1.1, or 1.0, or 0.5) percent manganese, a maximum of 2.5 (or 2.4, or 2.3, or 2.2, or 2.1, or 2.0, or 1.5, or 1.0, or 0.5) percent iron, a maximum of 0.3 (or 0.25, or 0.2, or 0.15, or 0.1) percent carbon, a maximum of 0.024 (or 0.023, or 0.022, or 0.021, or 0.020, or 0.019), or 0.018, or 0.017, or 0.016, or 0.015, or 0.010, or 0.005) percent sulfur, and a maximum of 0.5 (or 0.4, or 0.3, or 0.3, or 0.1) percent silicon.

In certain insulated sphere embodiments each of the insulation securing cables may be tensioned to at least 100 lb near the poles of the spherical pressure vessel, or at least 125, or at least 160, or at least 185, or at least 200 lb, up to a tension of about 400 lb for cables near the equator of the spherical pressure vessel or at least 450, or at least 480, or at least 490, or at least 500 lb for cables near the equator.

Certain insulated sphere embodiments may comprise an equatorial flashing folded over the standing seams, and a C-channel flashing, a portion of which is inserted under the equatorial flashing, then pop riveted thereby creating a seal. The C-channel flashing may be installed between insulation panels and further riveted thereto and to the standing seams. Between the standing seams the equatorial flashing and C-channel flashing comprise arcuate sheet metal portions having a shape similar to the arcuate shape of the sphere and the equatorial support bar.

Insulation kits are another aspect of the disclosure. As mentioned herein, one kit may comprise (or consist essentially of, or consist of)

i) an equatorial support comprising (or consisting essentially of, or consisting of):

A) a metal equatorial support bar (which may be composed of one or more segments) configured to have upper and lower metal rods attached thereto, the metal rods configured to be attached to a plurality of metal tabs that are in turn configured to be attached to respective upper and lower sides of the bar, the equatorial support bar configured to have a radius of curvature greater than a radius of curvature of a sphere to be insulated, the sphere having an external surface;

B) the equatorial support bar further configured to have a plurality of metal clips extending away from a major surface of the bar, the clips each having one or more passages configured to accept one or more additional metal rods;

C) one or more bolting plates configured to secure ends of the equatorial support bar, or corresponding ends of segments of same;

ii) one or more insulation layers and a plurality of metal bands each having first and second ends, the insulation layers configured to be held to an external surface of the sphere, each layer configured to be held by some of the plurality of metal bands arcuately shaped and laterally spaced about the sphere, the metal bands each having first and second ends configured to be attached to one of the rods at opposite sides of the sphere;

iii) a cable support matrix comprising a plurality of metal cables and a plurality of metal straps, the cables and straps configured to be arcuately shaped about the sphere, each metal strap configured to have a plurality of spaced apart (preferably uniformly spaced) arcuate loops extending away from a first major surface of each metal strap, the metal straps figured to be positioned so that the arcuate loops extend away from the sphere wall external surface, each arcuate loop defining a passage therethrough configured to accept one of the cables, the arcuate loops corresponding in number at least to the plurality of cables, each of the plurality of metal cables configured to be routed through horizontally passages in arcuate loops of the arcuately shaped laterally spaced metal straps; and iv) a plurality of insulation panels configured to be secured to the cables by a plurality of fasteners, each insulation panel comprising insulation material and an exterior metal jacket, each insulation panel configured to be positioned between horizontally adjacent insulation panels configured with standing seams.

Another aspect of the disclosure is a method of insulating a spherical pressure vessel (sphere, storage tank) comprising (or consisting essentially of, or consisting of):

(a) attaching an equatorial support to the sphere wall exterior surface, the equatorial support comprising (or consisting essentially of, or consisting of):

i) a metal generally horizontal equatorial support bar (which may be composed of one or more segments) having upper and lower metal rods attached to a plurality of metal tabs that are in turn attached to respective upper and lower sides of the bar, the equatorial support bar having a radius of curvature greater than the radius of curvature of the sphere;

ii) the equatorial support bar further comprising a plurality of metal clips extending away from a major surface of the bar, the clips each having one or more passages configured to accept one or more additional metal rods;

iii) one or more bolting plates securing ends of the equatorial support bar, or corresponding ends of segments of same;

b) attaching one or more insulation layers to the external surface of the sphere wall by i) placing insulation material against the sphere wall exterior surface;

ii) laterally spacing a plurality of arcuately shaped metal bands about the sphere, each having first and second ends, iii) attaching the first end to one of the rods, and iv) attaching the second end to the same rod at an opposite side of the sphere;

c) installing a cable support matrix over the one or more insulation layers of step (b), by i) placing a plurality of arcuate laterally spaced metal straps over the one or more insulation layers, the metal straps having a plurality of spaced apart arcuate loops on external surfaces of the straps facing away from the sphere wall external surface, ii) selecting a plurality of cables comprising (consisting essentially of, or consisting of) metal selected from the group consisting of stainless steel and a solid-solution alloy having a melting point range of 2370 to 2460° F. (1300 to 1350° C.) consisting essentially of (or consisting of) from 28 to 34 percent copper, a minimum of 63 percent nickel, a maximum of 2.0 percent manganese, a maximum of 2.5 percent iron, a maximum of 0.3 percent carbon, a maximum of 0.024 percent sulfur, and a maximum of 0.5 percent silicon, iii) routing the plurality of metal cables through horizontally aligned passages in horizontally aligned arcuate loops, the number of arcuate loops on each strap corresponding in number to the plurality of cables; and iv) tensioning the cables; and d) securing a plurality of insulation panels to the cables of the cable support matrix by use of a plurality of fasteners, each insulation panel comprising insulation material and an exterior metal jacket, each insulation panel positioned between horizontally adjacent insulation panels with standing seams.

In certain embodiments, step (d) may comprise passing one of the insulation securing cables through a plurality of the eyelets on a plurality of horizontal levels, and tensioning the cables to a tension of at least 100 lb near the poles of the spherical pressure vessel, or at least 125, or at least 160, or at least 185, or at least 200 lb, up to a tension of about 400 lb for cables near the equator of the spherical pressure vessel or at least 450, or at least 480, or at least 490, or at least 500 lb for cables near the equator.

The primary features of the systems, kits, combinations, and methods of the present disclosure will now be described with reference to the drawing figures, after which some of the construction and operational details, some of which are optional, will be further explained. The same reference numerals are used throughout to denote the same items in the figures.

With reference to the drawings, and in particular FIG. 1, a preferred insulated sphere embodiment 100 of the present invention is illustrated comprising panels 10 attached to a cable support matrix comprising a plurality of lateral stainless steel (for example T304 or equivalent, T316 or equivalent, or MONEL® 400 or equivalent) cables 16 and a plurality of vertical straps or bands 36, sometimes referred to herein as "belt-loop" straps. Although the systems and methods of the present disclosure are particularly useful for insulating spherically shaped tanks, it will be understood that the invention is not restricted by the shape of the tank, and indeed may be useful for tanks of various different shapes.

Batts of insulation material 12 may be applied directly to the tank surface 11 and affixed to the tank surface using metal straps, as explained herein. The systems and methods of the present disclosure not only protect the insulation material from the elements, but also provides a sealed vapor barrier around the tank structure. Thus, the systems and methods of the present disclosure may be useful in conjunction with various different insulation application methods for enhancing and extending the use of the insulation on tank structures.

FIG. 1 illustrates schematically embodiment 100 of an insulated spherical storage tank supported by legs 52 (illustrated in phantom) positioned at intervals around the tank. Typically, a spherical tank will have ten or more legs, which connect to the tank at the midpoint (equator) of the tank. Also illustrated schematically in FIG. 1 is a cover strip 42 that runs horizontally around the equator of the spherical tank. The cover strip preferably is a steel or aluminum flashing that is about 6 inches (15 cm) in width and about 0.125 inch (0.3 cm) in thickness and fits over standing seams and between panels as described herein, and is attached using pop rivets. The equator of the tank is also provided with an equator support bar 6 (illustrated schematically in FIGS. 8 and 10-12) for anchoring or securing a plurality of arcuate, laterally spaced upper metal insulation support straps or bands 40, 43, and 45 thereto, as well as a plurality of arcuate, laterally spaced lower metal insulation support straps or bands 40', 43', and 45' thereto (FIG. 8).

Actually there will be a plurality of upper straps 40 for securing a first layer of insulation material 12 to the upper hemisphere, a second plurality of straps 43 for the next layer, another plurality of straps 45 for the next layer, and so on until the desired number of layers of insulation 12 are installed. Similarly, there will be a plurality of straps 40' for securing a first layer of insulation material 12 to the lower hemisphere, a plurality of straps 43' for the next layer, and another plurality of straps 45' for the next layer, and so on until the desired number of layers of insulation 12 are installed. Each strap 40, 43, 45, 40', 43', and 45' has first and second ends attached to one of the rods supported by an equatorial support bar at opposite sides of the sphere, as will be explained in reference to FIGS. 8, 8A, and 8B. The number of lower and upper arcuate insulation support straps may be varied depending on the size and circumference of the storage tank.

Figure 8:
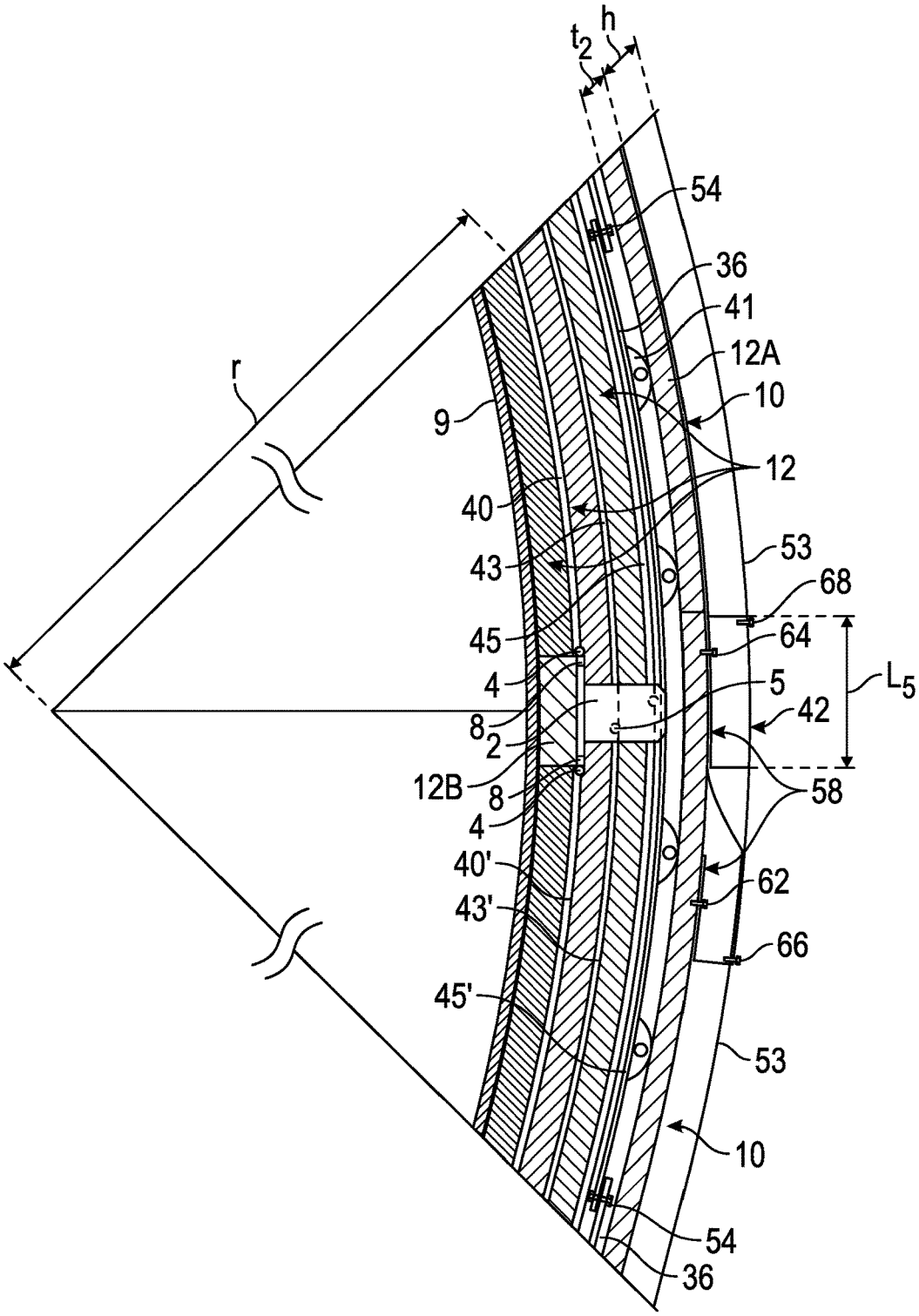
FIG. 8 is a detailed schematic side sectional view of a portion an insulated sphere in accordance with one embodiment of the disclosure, illustrating an equator support bar with straps welded to the rods of the equatorial support bar, and other features.
Figure 8A:
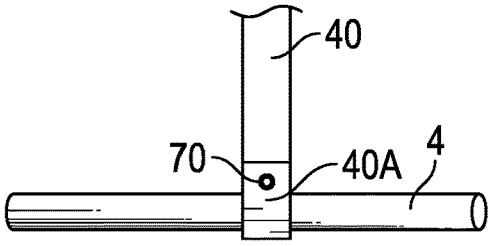
FIGS. 8A and 8B are detailed schematic side and end views of an alternative method of securing the straps to the rods of the equatorial support bars using rivets or screws.
Figure 8B:
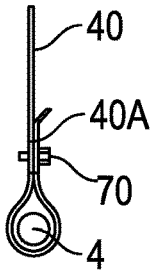

Now referring to FIGS. 1, 3, 8, 8A and 8B each of upper insulation support straps 40, 43, and 45, and each of lower insulation support straps 40', 43', and 45', has a first end secured to rods 4 or 5 (FIG. 8). The securing or attachment may be by welding, brazing, or some similar heat-joining mechanism, or the first ends of straps 40, 43, 45, 40', 43', and 45' may be bent around the rods and fastened thereto with rivets, screws, or the like, as illustrated schematically in FIGS. 8A and 8B, illustrating schematically an end 40A of strap 40 bent around rod 4 and secured to itself with a screw 70. Near the top and bottom poles of the sphere, each of upper insulation support straps 40, 43, and 45, and each of lower insulation support straps 40', 43', and 45', has a second end secured to a collar made of cable. Insulation support straps 40, 43, 45, 40', 43', and 45' that hold each layer of insulation on before the cable support matrix are installed only from the equator to the respective sphere poles. At the poles, a collar may be fashioned from cable that is wrapped around the center nozzle or group of nozzles near each sphere pole. Such collars are illustrated and described in assignee's U.S. application No. 62/327,830, filed Apr. 26, 2016, FIGS. 15 and 16.

Referring again to FIG. 1, insulated sphere embodiment 100 also has a plurality of arcuate, laterally spaced cable support matrix metal straps 36 that may be varied depending on the size and circumference of the storage tank. Preferably, each strap 36 is steel (preferably stainless steel, for example T 304 or equivalent) that is about 1.5 inch (3.8 cm) in width, 0.125 inch (0.3 cm) in thickness, and 12 feet (3.7 m) in length, lapped and bolted together so that the bolts face outward (FIG. 8).

After insulation material 12 are secured to the sphere by the plurality of upper and lower arcuate insulation support straps, a plurality of arcuate cable support matrix straps 36 are installed at intervals around the exterior of the tank, and stranded wire cables 16 are positioned horizontally at spaced intervals about the outer circumference of the tank that are tightened and held in place by turnbuckles 19 which are at the end of each cable, or other cable tensioners, such as toggle end and tensioner, fork end and tensioner, threaded stud assemblies, tension fork assemblies, and the like, such as available from Sta-Lok Terminals Ltd., Essex, United Kingdom.

Cables 16 preferably are made up of a series of twisted steel wires and are horizontally disposed in a generally parallel, vertically spaced arrangement, as best illustrated in FIGS. 1, 3, 4, and 9. The number of cables 16 may be varied depending on the size and circumference of the storage tank. Typically, the cables are positioned at intervals of approximately 3 feet (90 cm). The cables may range in diameter from about 0.25 inch (0.6 cm) in diameter to about 0.3125 inch (0.8 cm).

Cables 16 are not fastened to vertical straps 36, but are looped through several metal "belt loops" 41 having holes 49 therethrough, the number of belt loops for each arcuate strap 36 equaling the number of cables 16. The belt loops or eyelets 41 may be formed (drilled) in plates welded to straps 36, or more preferably the straps 36 are punched (machines or formed) to form a plurality of belt loops 41. If welded, belt loops 41 may be steel or aluminum square or arcuate plate 0.25 inch (0.6 cm) in thickness and 1-3 inches (2.5-7.5 cm) in length. If belt loops 41 are punched in straps 36, the material of the belt loops 41 is the same as that os the arcuate straps 36. In contrast to prior designs, such as detailed in assignee's previous U.S. Pat. No. 5,263,603, cables 16 are not secured to vertical straps 36, but rather are dimensioned to slide through holes 49 in belt loops 41 as they expand or contract.

Arcuate straps 36 and horizontal cables 16 form a strong and flexible web around the outer surface of the storage tank, which is capable of flexing in severe weather conditions, and when the tank structure expands and contracts due to temperature changes. The web may be installed quickly and economically without the use of specialized tools and equipment.

Figure 2:
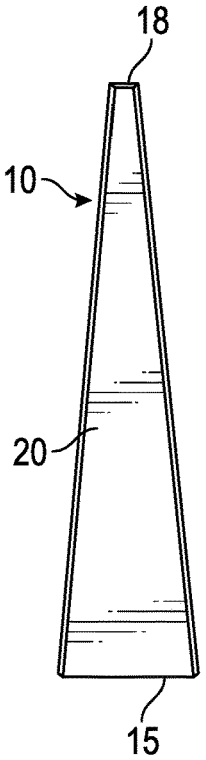
FIG. 2 is a front view illustrating schematically a trapezoid-shaped aluminum or stainless steel panel or "gore" for use with insulating spherical storage tanks in accordance with the present disclosure (gores may or may not have dunnage attached to prevent cable telegraphing)
Figure 3:
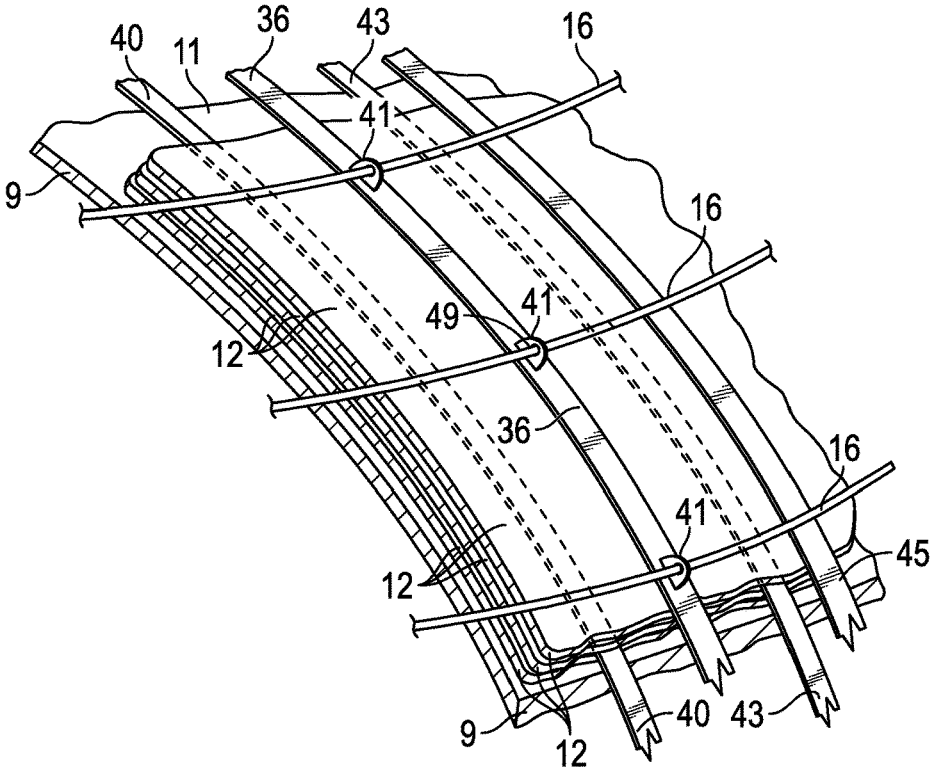
FIG. 3 is an isometric view, partially in phantom, illustrating schematically three insulation layers held by arcuate stainless steel straps to a sphere external surface, and a cable support matrix comprising cables and more arcuate stainless steel straps, the cables inserted freely through and unsecured to "belt loops" of the outer-most straps and then tensioned in accordance with one embodiment of the present disclosure.

Referring to FIG. 2, panel sections 10, sometimes referred to in the art as "gores", are attached exteriorly of the cable support matrix or web. In a preferred embodiment for use with spherical storage tanks, each panel 10 comprises a channel-shaped, roll formed metal section 20 with a trapezoid shape, as illustrated schematically in FIG. 2. The panels may be aluminum or steel with a surface coating if desired. The first end 15 of the panel is substantially wider than the second end 18 of the panel. For example, the first end may be approximately 3 feet (90 cm) in width, and the second end may be 3 inches (7.6 cm) in width. The panels are flexible to curve over the shape of the spherical tank. It is preferred that one set of panels be installed above the midpoint or equator of the tank, and a second set of panels be installed below the midpoint of the tank. Panels 10 in most embodiments will have polyisocyanurate dunnage 12A attached to the backside thereof (see FIGS. 4, 6, and 8) to prevent cable telegraphing (showing through metal section 20). Dunnage 12A may be 0.5 (1.3 cm) inch up to 2.0 inches (5.1 cm) in thickness, more typically 1 inch (2.5 cm) thick polyisocyanurate.

Figure 4:
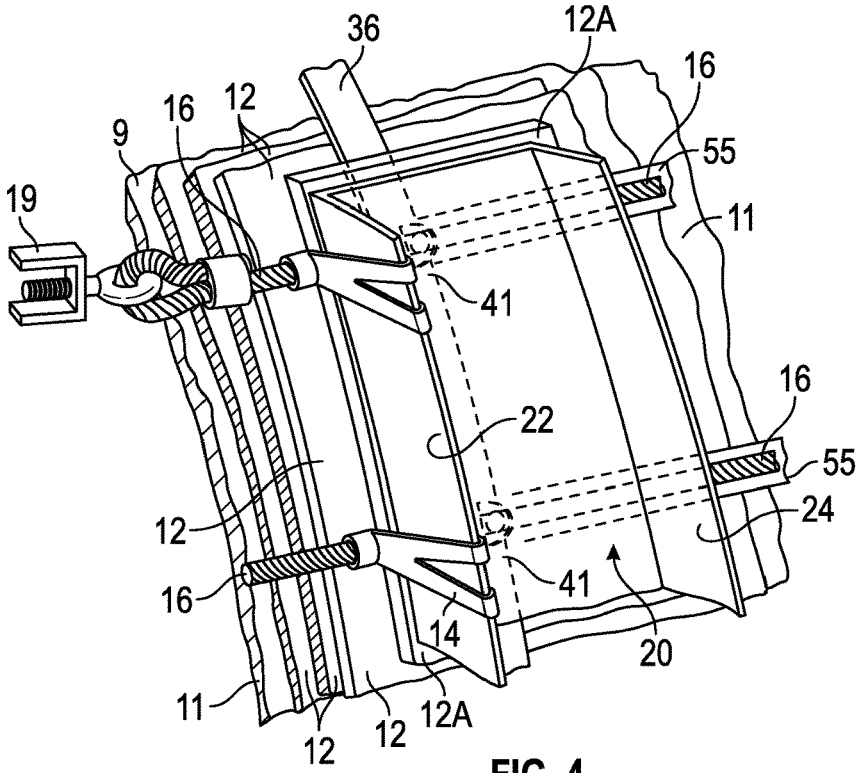
FIG. 4 is an isometric view, partially in phantom, similar to the embodiment illustrated schematically in FIG. 3 but having a fourth insulation layer (dunnage) and illustrating how the cables of the insulation support matrix are attached to standing seams using fasteners and illustrating schematically securing panel sections to the cables in accordance with one embodiment of the present disclosure.

Now referring to FIG. 4, the opposing edges of section 20 are provided with an upstanding and opposed straight first flange 22 and second flange 24. First flange 22 is slightly taller than second flange 24. First flange 22 can be folded over second flange 24 when a pair of panels are disposed in adjoining relationship. Another feature, optional, is the provision of aluminum backing strips 55 behind each cable 16 between each strap 36.

Figure 5:
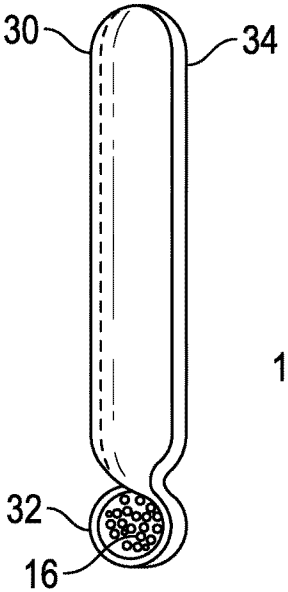
FIG. 5 is a vertical side view illustrating schematically the continuous fastener looped around one cable in accordance with one embodiment of the present disclosure.

Panels 10 are affixed crosswise of cables 16 using a plurality of continuous pieces of strapping material or fastener 14. Each fastener 14 is a thin continuous piece of strapping material having a first end 30, a middle section 32 and a second end 34, as illustrated schematically in FIG. 5.

Figure 6:
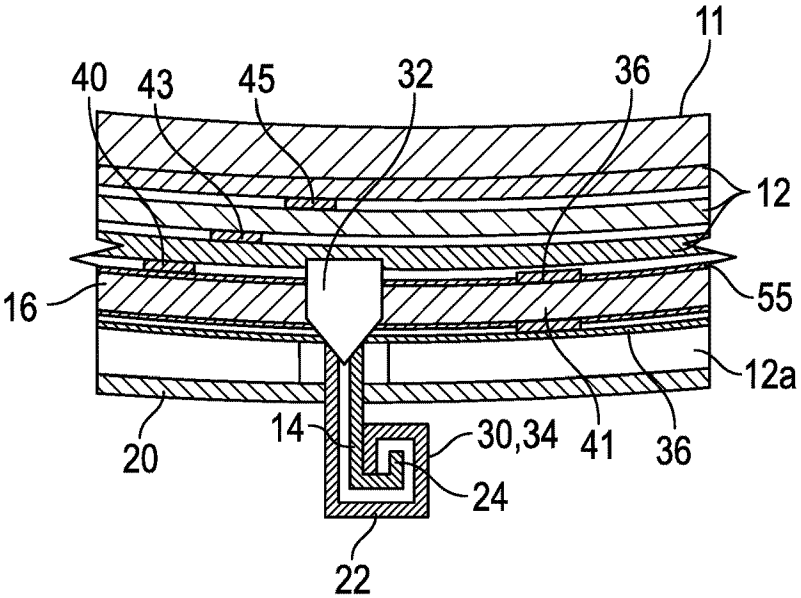
FIG. 6 is a section view illustrating schematically a joint between a pair of panels with the continuous fastener of FIG. 5 looped around the cable and interposed between the panels.

Referring to FIG. 6, fastener 14 is first inserted around and under a cable 16 such that middle section 32 of fastener 14 rests around the periphery of the cable with first end 30 and second end 34 disposed 90° or rotated about the cable and placed in side by side spaced relationship with respect to each other. Then a pair of panels 10 is placed crosswise to cable 16 such that the second flange 24 of the first panel 10 is spaced in side-by-side spaced relationship with the first flange 22 of the second panel. The first end 30 and second end 34 of the fastener 14 are then bent over the top of the second flange 24. The first flange 22 of the second panel section is then folded about the ends 30 and 34 of the fastener and over the second flange 24 of the first panel. An electric closure tool or the like provided with rollers that roll first flange 22 and second flange 24 over the fastener 14 is moved along the tank seam, closing the seam. The flanges are folded over again as same tool is once again moved along the seam formed by the adjacent flanges, with the finished closure seam being as illustrated in FIG. 6.

Figure 7:
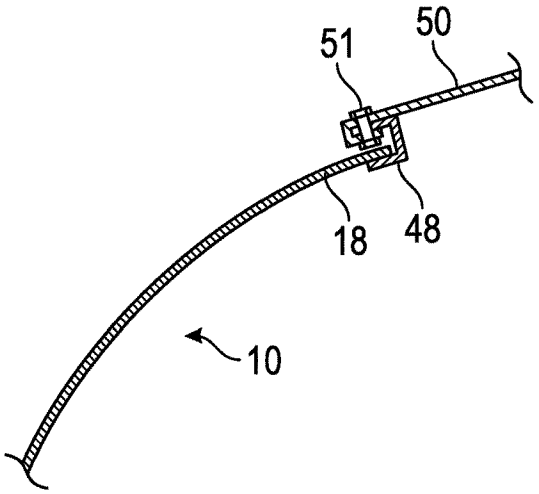
FIG. 7 is a section view illustrating schematically a center cap attached to the end of an insulation panel at the top or bottom of the sphere in accordance with one embodiment of the present disclosure.

After the panels 10 are installed, cover strip or flashing 42 may be installed at the midpoint of the tank to cover the ends of the panels. Additionally, as illustrated schematically in FIG. 7, a center metal plate 50 may be installed to cover the narrow end 18 of each trapezoid-shaped panel 10 near the top and bottom surfaces of the tank. Top and bottom center plates 50 may be attached to a "C" shaped section 48 that fits around the narrow end 18 of each panel, and connected with pop rivet 51. Thus, the top and bottom center plates 50 may be installed without piercing the panel section 10 and without sacrificing the integrity of the vapor barrier around the tank.

FIGS. 8-13 illustrate schematically more details of a preferred insulation system embodiment, especially the equator support bar 6. More specifically, FIG. 8 is a schematic cross-sectional view of an equatorial portion of a spherical tank wall and insulation system of the present disclosure installed thereon, illustrating upper stainless steel straps 40, 43, and 45 and lower stainless straps 40', 43', and 45' holding respective insulation layers 12 to the tank wall 9. FIG. 8 illustrates how lower end of stainless steel strap 40 may be welded to rod 4 of equatorial support bar 6, and lower ends of straps 43, 45 may similarly be welded to rods 5 positioned in holes 28 (FIG. 12) of equatorial support bar clip 2 (it being understood there are a plurality of clips 2 on equatorial support bar 6). In similar fashion the respective upper ends of lower straps 40', 43', and 45' may be welded to respective rods 4 and 5. Alternatively, the attachment method illustrated schematically in FIGS. 8A and 8B may be used, as explained previously, or some of the first ends of the straps may be welded to the rods, and some of the second ends attached to the rods using the method of FIGS. 8A and 8B. The attachment method of FIGS. 8A and 8B may be more economical simpler to employ. These same methods may be used to secure second ends of the straps to top pole collar and bottom pole collar fashioned from cable, as explained previously.

Figure 9:
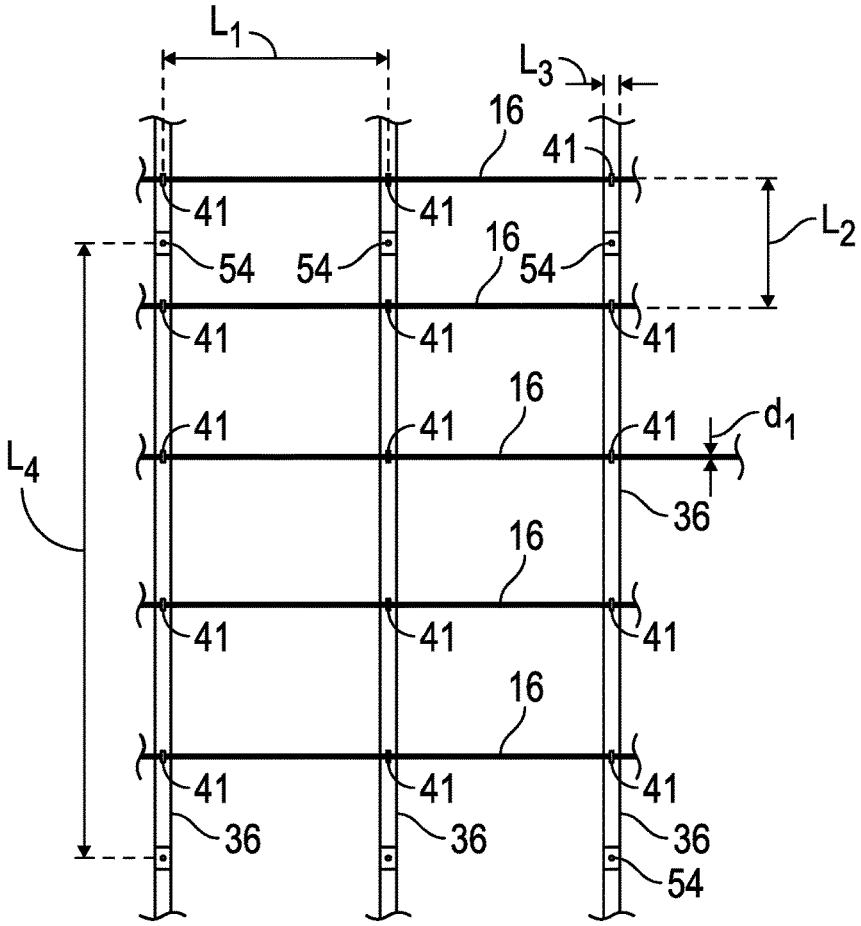
FIG. 9 is a front view, and FIG. 10 a side view; illustrating schematically a portion of a cable support matrix.
Figure 10:
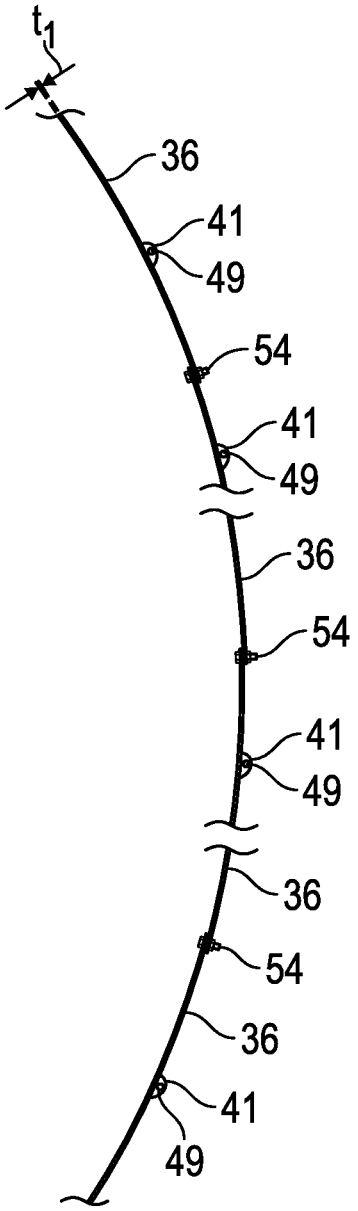

A single long slab, or a plurality of blocks of insulation material 12B (one being illustrated in FIG. 8) holds equatorial support bar 6 in position away from tank wall 9. Slab or blocks 12B may be dimensioned as having the same thickness as the innermost layer of insulation 12, with a length of several inches (cm) up to a meter or more. FIGS. 8, 9, and 10 illustrate schematically also how cable support matrix steel straps 36 are lapped and bolted together using carriage bolts 54, with the bolts 54 facing outwards. Carriage bolts 54 may for example be 0.5 inch (1.3 cm) diameter, 1 inch (2.5 cm) long carriage bolts. The bottom-most support strap 36 is typically field cut in order to tit securely.

Referring again to FIG. 8, equatorial flashing 42 is illustrated folded over standing seam 53 formed by folded over first flange 22, second flange 24, and strapping 14 as previously described. Flashing 42 is pop riveted to seam 53 using pop rivet 68, and further riveted to panel 10 using another pop rivet 64. Prior to fixing rivet 64, a long end of a C-channel flashing 58 is inserted under equatorial flashing 42, then the pop rivet 64 installed thereby creating a seal. C-channel flashing 58 is installed between panels 10, and further riveted thereto with another pop rivet 62 and to standing seam 53 with a pop rivet 66.

FIGS. 8 and 9 illustrate details of stainless steel straps 36, belt loops 41, and holes therethrough 49 for passage of cables 16. Belt loops 41 are preferably also stainless steel, and may be punched into the straps 36, or welded or bolted to straps 36, with punching being preferred. FIG. 9 also illustrates carriage bolts 54 oriented so that they face outward (away from tank wall 9). It will be understood that the arcuate curvature of cables 16 and straps 36, corresponding to the arcuate curvature of the sphere, are not detailed in FIG. 9.

Figure 11:
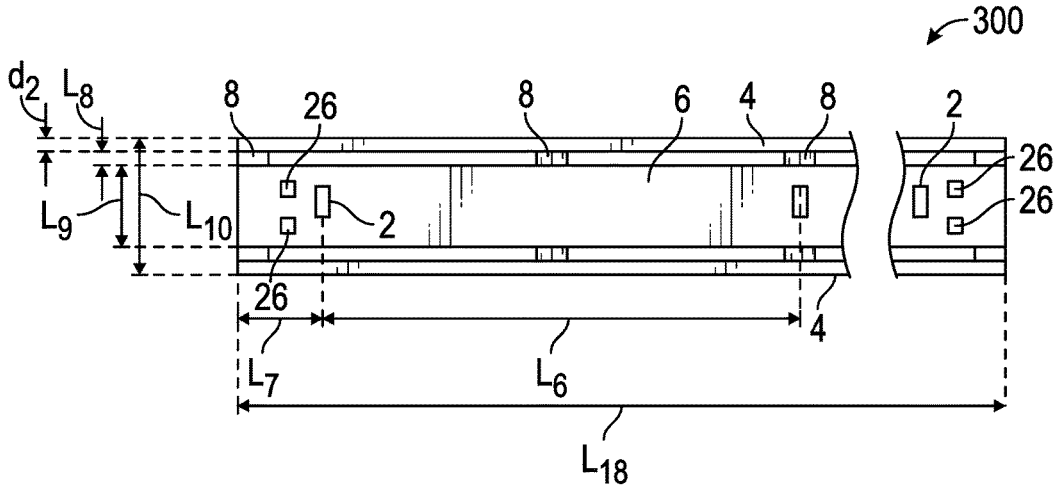
FIG. 11 is a front elevation view.
Figure 12:
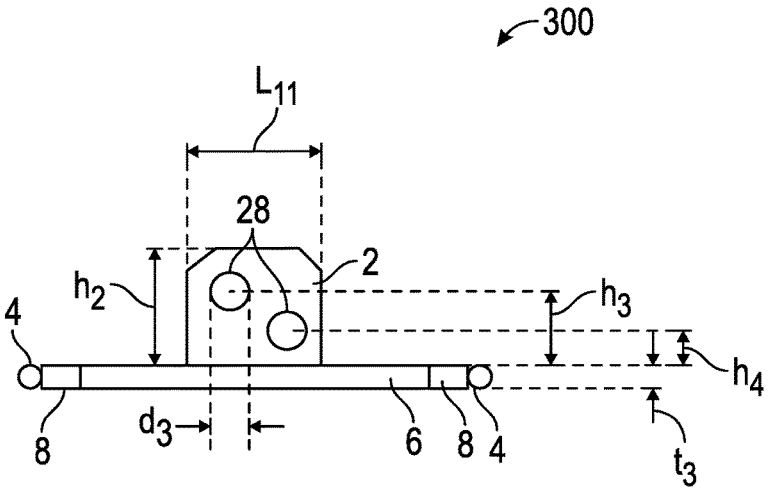
FIG. 12 is a side elevation view, illustrating schematically a portion of an equator support bar.
Figure 13:
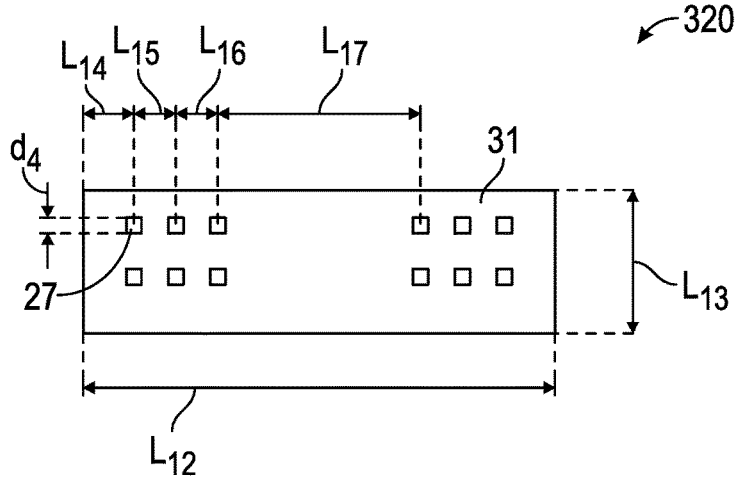
FIG. 13 is a front elevation view illustrating schematically a bolting plate for the equator support bar illustrated schematically in FIGS. 11 and 12.

FIGS. 11 and 12 illustrate schematic front and end elevation views, respectively, of one embodiment 300 of an equatorial support in accordance with the present disclosure, comprising an equatorial support bar 6, preferably stainless steel, having a plurality of stainless steel or other corrosion-resistant tabs 8 welded thereto along its length, and a pair of rods 4 (round stainless steel or other corrosion-resistant metal bar stock) welded to the tabs 8. Sets of holes 26 (square or other shape) are provided near each end of equatorial support band 6. Holes 26 are adapted to be lined up with respective sets of holes 27 in equatorial support bar bolting plate 31 (embodiment 320, illustrated schematically in the front elevation view of FIG. 13), and bolts inserted therein (the bolts are not illustrated) for securing the equatorial support bar together. Stainless steel or other metallic corrosion-resistant equatorial support clips 2 are provided at spaced positions along the equatorial support bar 6, such as positioned from about 10 to 30 inches (25 to 76 cm) apart. The lower limit of this distance may be 11, 12, 13, 14, 15, 16, 17, or 18 inches, or any fraction thereof (such as 15.5 inches). The upper limit of this distance may be 29, 28, 27, or 26 inches, or any fraction thereof (such as 27.5 inches). Support clips 2 include through holes or passages 28 (corresponding in number to the number of rods 5 employed, which in turn generally corresponds in the number of insulation layers 12 installed). Rods 5 may either be allowed to freely move inside through holes 28, or they may be fastened thereto, such as by welding, or brazing, or even threaded therein in certain embodiments.

System and method embodiments of the present disclosure provide a panel system that seals the insulation from the elements, without piercing the vapor barrier or otherwise allowing moisture to penetrate the exterior to reach the insulation. Another advantage of systems and methods of the present disclosure is that it allows substantial flexing between adjacent panel sections. For example, cable 16 will be allowed to rotate and move in sliding fashion through the belt loop holes 49 due to expansion and contraction of the system. The vertical straps allow flexing of the cables to prevent damage due to expansion, contraction or other movement of the cables. Also, because the first flange 22 and second flange 24 are double-rolled over the fastener 14, the present invention allows for a continuous uninterrupted closure seam having no exposed joints for possible leakage and subsequent corrosion.

Support cables 16 may comprise or consist essentially of or consist of metal, for example of corrosion-resistant, flexible alloys such as T304 stainless steel (or analogs thereof, such as UNS S30400; AMS 5501, 5513, 5560, 5565; ASME SA182, SA194 (8), SA213, SA240; ASTM A167, A182, A193, A194) or T316 stainless steel (or analogs thereof, such as UNS S31600, SS316, 316SS, AISI 316, DIN 1.4401, DIN 1.4408, DIN X5CrNiMo17122, TGL 39672 X5CrNiMo1911, TGL 7143X5CrNiMo1811, ISO 2604-1 F62, ISO 2604-2 TS60, ISO 2604-2 TS61, ISO 2604-4 P60, ISO 2604-4 P61, ISO 4954 X5CrNiMo17122E, ISO 683/13 20, ISO 683/13 20a, ISO 6931 X5CrNiMo17122, JIS SUS 316 stainless steel, or the alloy known under the trade designation MONEL® nickel-copper alloy 400. The composition and some physical properties of MONEL® nickel-copper alloy 400 are summarized in Tables 2 and 3 (from Publication Number SMC-053 Copyright © Special Metals Corporation, 2005), and some commercially available cables are listed in Table 4. The composition and some physical properties of T304 and T316 stainless steels are summarized in Tables 5 and 6. MONEL® nickel-copper alloy 400 (equivalent to UNS N04400/W.Nr. 2.4360 and 2.4361) is a solid-solution alloy that can be hardened only by cold working. It has high strength and toughness over a wide temperature range and excellent resistance to many corrosive environments.

The cables 16 of the insulation support system may be tensioned, the ends of cables 16 being connected in known fashion by a turnbuckle or other cable end fastener system (known in the art and therefore not illustrated). Cables 16 may be tensioned to a minimum of 100 lb near the poles of the spherical pressure vessel, or at least 125, or at least 160, or at least 185, or at least 200 lb, up to a tension of about 400 lb for cables near the equator of the spherical pressure vessel for sphere insulation. Since the cables are located outside of the inner insulation layers 12, tension may be tested before installation and after installation, and even during operation of the underlying sphere, pressure vessel or storage vessel. Suitable cable tension testers are available commercially, for example those available from Tensitron Inc., Longmont, Colo., (USA). Insulation layers 12 may be the same or different insulation material and thickness from layer to layer. The total thickness of all insulation layers depends on the type of insulation materials used, but may range from about 8 to 12 inches (about 20 to 30 cm). Insulation layer 12A is preferably polyisocyanurate foam sprayed onto the backside of 20, but could be the same as insulation materials 12 or some other insulation material.

Figure 14:
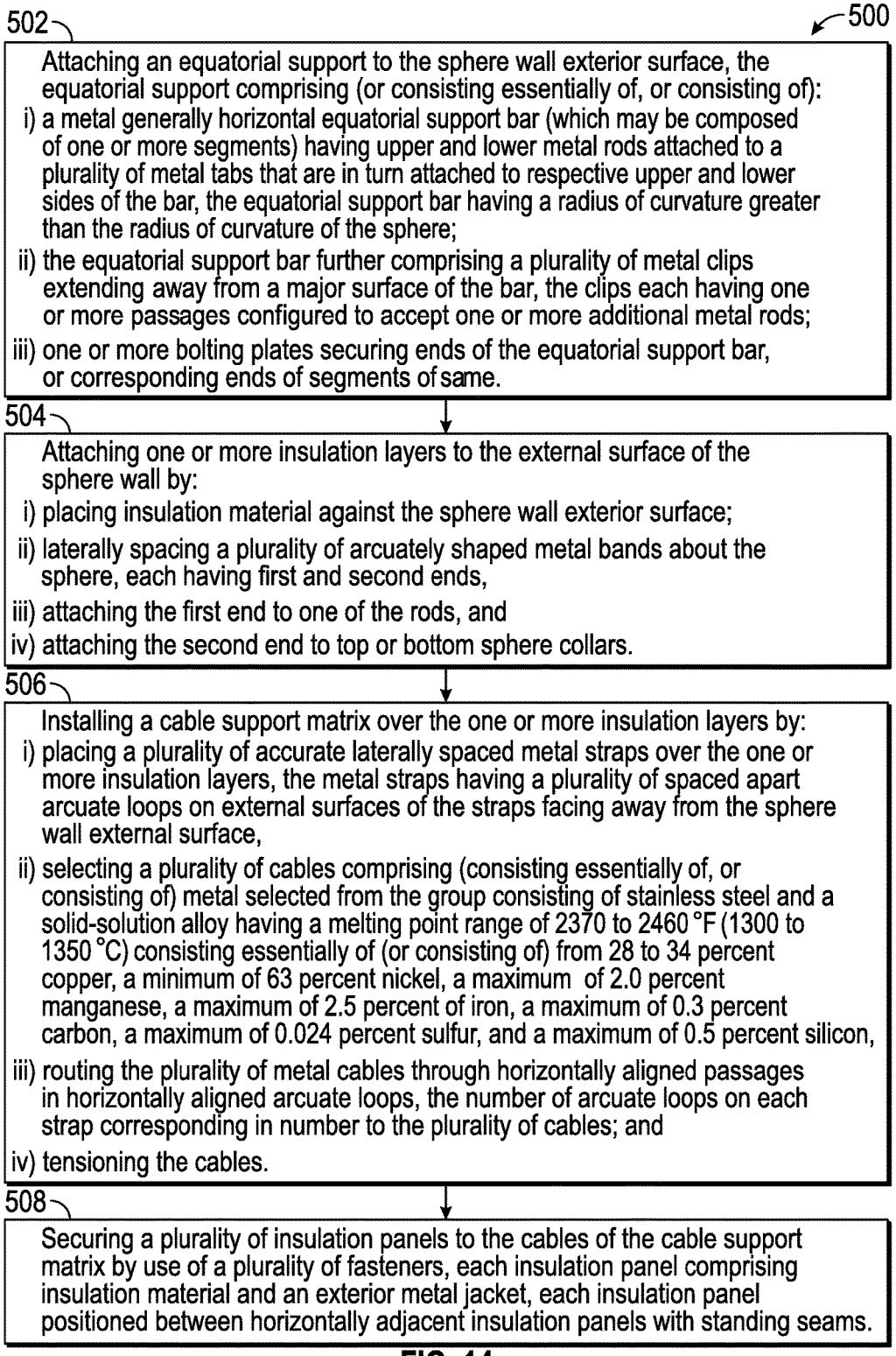
FIG. 14 is a logic diagram of one method embodiment in accordance with the present disclosure for installing an insulation system on a sphere in accordance with the present disclosure.

FIG. 14 is a logic diagram of one method of insulating a non-insulated spherical pressure vessel, reactor, or storage tank in accordance with the present disclosure. Method embodiment 500 includes (Box 502) attaching an equatorial support to the sphere wall exterior surface, the equatorial support comprising (or consisting essentially of, or consisting of): i) a metal generally horizontal equatorial support bar (which may be composed of one or more segments) having upper and lower metal rods attached to a plurality of metal tabs that are in turn attached to respective upper and lower sides of the bar, the equatorial support bar having a radius of curvature greater than the radius of curvature of the sphere; ii) the equatorial support bar further comprising a plurality of metal clips extending away from a major surface of the bar, the clips each having one or more passages configured to accept one or more additional metal rods; iii) one or more bolting plates securing ends of the equatorial support bar, or corresponding ends of segments of same.

Method embodiment 500 further comprises (Box 504) attaching one or more insulation layers to the external surface of the sphere wall by i) placing insulation material against the sphere wall exterior surface; ii) laterally spacing a plurality of arcuately shaped metal bands about the sphere, each having first and second ends, iii) attaching the first end to one of the rods, and iv) attaching the second end to a top or bottom pole collar.

Method embodiment 500 further comprises (Box 506) installing a cable support matrix over the one or more insulation layers by i) placing a plurality of arcuate laterally spaced metal straps over the one or more insulation layers, the metal straps having a plurality of spaced apart arcuate loops on external surfaces of the straps facing away from the sphere wall external surface, ii) selecting a plurality of cables comprising (consisting essentially of, or consisting of) metal selected from the group consisting of stainless steel and a solid-solution alloy having a melting point range of 2370 to 2460° F. (1300 to 1350° C.) consisting essentially of (or consisting of) from 28 to 34 percent copper, a minimum of 63 percent nickel, a maximum of 2.0 percent manganese, a maximum of 2.5 percent iron, a maximum of 0.3 percent carbon, a maximum of 0.024 percent sulfur, and a maximum of 0.5 percent silicon, iii) routing the plurality of metal cables through horizontally aligned passages in horizontally aligned arcuate loops, the number of arcuate loops on each strap corresponding in number to the plurality of cables; and iv) tensioning the cables.

Method embodiment 500 further comprises (Box 508) securing a plurality of insulation panels to the cables of the cable support matrix by use of a plurality of fasteners, each insulation panel comprising insulation material and an exterior metal jacket, each insulation panel positioned between horizontally adjacent insulation panels with standing seams.

In certain embodiments, certain insulation layers may include the provision of metal foil-enclosed insulation material, such as metal-foil enclosed mineral wool insulation and metal-foil enclosed aerogel insulation panels. The metal of the metal foil-enclosed insulation may be T-304 stainless steel foil, of thickness of about 0.002 inch, and may optionally include T-304 stainless steel hex wire for support. The mineral wool insulation may be, for example, 3.5-inch thick 8 lb. mineral wool batt. The equatorial cover flashing 42 and C-channel flashing 58 are preferably made of a corrosion-resistant metal, for example T 304 stainless steel, or other steel or more exotic alloy.

The insulation systems disclosed of the present disclosure are the most advanced sphere insulation panel systems available today, providing long-term maintenance-free thermal control, saving hundreds of thousands of dollars by not having to replace the system due to fastener failure, water intrusion and drum damage from expansion restriction or cold spots. Each insulation system may be pre-fabricated in a controlled factory setting to meet the highest quality control standard, and may therefore be custom engineered for specific pressure vessel size and structure restrictions. The metal jacket, especially when stainless steel such as 304, 316, or other, combined with a standing seam and C-channel combination, provides a weather proof, durable, maintenance-free sphere insulation that allows thermal movement. The insulation panels may be designed and manufactured to allow ease of handling and thermal movement, for example the inclusion of spring-loaded handles such as described in assignee's U.S. application No. 62/327,830, filed Apr. 26, 2016, incorporated by reference herein. The systems are designed to take in consideration the constant thermal expansion and contraction a sphere goes through in its cycle, and may be installed on existing spheres on a turn-around basis or on a totally new sphere or other tank. Stainless steel jacketing with standing seams and C-channels allows dust to be washed off of spheres without compromising the efficiency of the insulation system. Furthermore, although the preferred insulating jacket metal for insulated spheres is stainless steel, other metals and/or metal alloys could be used. Aluminum may be preferred for its low weight, although billet aluminum may be preferred for its strength and may weigh more than cast aluminum.

The magnitude of lengths, thicknesses, heights, diameters, and other dimensions illustrated in FIGS. 8-13 and discussed herein are typical and not meant to be limiting in any way, but are summarized in Table 1. Length and width dimensions are denoted by "L" followed by a subscript: $L_1$, $L_2$, $L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, and $L_{18}$. Thicknesses, diameters, and heights of note are designated by $t_1$, $t_2$, and $t_3$, $d_1$, $d_2$, $d_3$, and $d_4$, and $h_1$, $h_2$, $h_3$, and $h_4$, respectively, any of which may be more or less than listed depending on strength requirements. The radius of curvature "r" of the equator support bar 6 (FIG. 8) is also noted in Table 1.

TABLE 1

| Dimensions[1] | | |
|---|---|---|
| Dimension or angle | Broad Range (inch except where indicated) | Preferred Range (inch except where indicated) |
| $L_1$ (dist. between 36) | 4 to 12 ft. | 6 to 10 ft. |
| $L_2$ (dist. between 16) | 2 to 6 ft. | 2 to 4 ft. |
| $L_3$ (width of 36) | 1 to 4 | 1 to 2 |
| $L_4$ (length of 36) | 6 to 18 ft. | 10 to 14 ft. |
| $L_5$ (width of 42) | 3 to 10 | 4 to 8 |
| $L_6$ (dist. between clips 2) | 10 to 30 | 18 to 26 |
| $L_7$ (dist. end of 6 to first clip 2) | 1.5 to 4 | 2 to 3 |
| $L_8$ (width of 8) | 0.25 to 1 | 0.25 to 0.75 |
| $L_9$ (width of 6) | 1.5 to 6 | 2 to 4 |
| $L_{10}$ (width of 300) | 2 to 8 | 2 to 6 |
| $L_{11}$ (width of 2) | 0.5 to 2 | 0.75 to 1.5 |
| $L_{12}$ (length of 31) | 4 to 10 | 6 to 8 |
| $L_{13}$ (width of 31) | 1.5 to 6 | 2 to 4 |
| $L_{14}$ (dist. from end of 31 to prox. 27) | 0.75 to 3 | 0.75 to 1.25 |
| $L_{15}$ (dist. between first two 27) | 0.25 to 1 | 0.5 to 1 |
| $L_{16}$ (dist. between second two 27) | 0.25 to 1 | 0.5 to 1 |
| $L_{17}$ (dist. of distal 27 from end 31) | 1.5 to 4 | 1.75 to 2.5 |
| $L_{18}$ (length of 6) | 6 to 18 ft. | 4 to 5 |
| $h_1$ (height of 53) | 0.5 to 2 | 0.75 to 1.25 |
| $h_2$ (height of 2) | 0.75 to 2 | 1 to 1.5 |
| $h_3$ (height of 28 distal) | 0.75 to 1.25 | 0.75 to 1 |
| $h_4$ (height of 28 proximate) | $0.5 \times h_3$ | $0.5 \times h_3$ |
| r (radius of curv. of 6) | radius of sphere + 4 in. | radius of sphere + 2 in. |
| $t_1$ (thickness of 36) | 0.0625 to 0.25 | 0.1 to 0.25 |
| $t_2$ (thickness of 12A) | 0.25 to 1 | 0.25 to 0.75 |
| $t_3$ (thickness of 6 and 31) | 0.1 to 0.5 | 0.2 to 0.3 |
| $d_1$ (diam. of 16) | 0.125 to 0.75 | 0.125 to 0.5 |
| $d_2$ (diam. of 4) | 0.25 to 0.75 | 0.25 to 0.44 |
| $d_3$ (diam. of 28) | 0.25 to 0.5 | 0.25 to 0.44 |
| $d_4$ (diam. of 27) | 0.25 to 0.75 | 0.375 to 0.625 |

[1]dimensions outside of these ranges may be acceptable

TABLE 2

| Chemical Composition, wt. %, of MONEL ® Alloy 400 | |
|---|---|
| Nickel (plus Cobalt) | 63.0 min. |
| Carbon | 0.3 max. |
| Manganese | 2.0 max. |
| Iron | 2.5 max. |
| Sulfur | 0.024 max. |
| Silicon | 0.5 max. |
| Copper | 28.0-34.0 |

TABLE 3

| Physical Constants of MONEL ® Alloy 400[a] | |
|---|---|
| Density, g/cm$^3$ | 8.80 |
| lb/in.$^3$ | 0.318 |
| Melting range, ° F. | 2370-2460 |
| ° C. | 1300-1350 |
| Modulus of Elasticity, $10^3$ ksi | |
| Tension | 26.0 |
| Compression | 26.0 |
| Torsion | 9.5 |
| Poisson's Ratio | 0.32 |
| Curie Temperature, ° F. | 70-120 |
| ° C. | 21-49 |

[a]these values also apply to MONEL alloy R-405, the free-machining version of MONEL alloy 400.

TABLE 4

| 7 × 19 MONEL ® 400 CABLE[1] | | | |
|---|---|---|---|
| Diameter (in.)[2] | Part Number[3] | Min. Breaking Strength (lbs.) | Approx. Weight Per 100 ft. |
| 3/32 | MC09479 | 480 | 1.8 |
| 1/8 | MC12579 | 875 | 3.3 |
| 5/32 | MC15679 | 1,350 | 5.2 |
| 3/16 | MC18879 | 1,950 | 7.5 |
| 7/32 | MC21979 | 2,650 | 10.5 |

TABLE 4-continued

| 7 × 19 MONEL ® 400 CABLE[1] | | | |
|---|---|---|---|
| Diameter (in.)[2] | Part Number[3] | Min. Breaking Strength (lbs.) | Approx. Weight Per 100 ft. |
| 1/4 | MC25079 | 3,500 | 13.5 |
| 9/32 | MC28179 | 4,400 | 17.0 |
| 5/16 | MC31379 | 5,450 | 21.0 |
| 3/8 | MC37579 | 7,850 | 30.0 |

[1]From Loos & Co., Inc., P.O. Box 98, Pomfret, CT 06258 (USA)
[2]Nominal Diameter excluding +/− tolerances
[3]Part numbers MC28179, MC31379, and MC37579 preferred for some spheres, especially

TABLE 5

| Chemical Composition, wt. %, of T304 and T316 SS | | |
|---|---|---|
| | T304 | T316 |
| Carbon | 0.08 max. | 0.08 |
| Chromium | 18-20 | 18 max. |
| Manganese | 2.0 max. | 2 |
| Molybdenum | 0 | 3 max. |
| Iron | 66.345-74 | 62 |
| Nickel | 8-10.5 | 14 max. |
| Phosphorous | 0.045 max. | 0.045 |
| Sulfur | 0.03 max. | 0.03 |
| Silicon | 1 max. | 1 |

TABLE 6

| Physical Constants of T304 and T316 SS | | |
|---|---|---|
| | T304 | T316 |
| Density, g/cm$^3$ | 8 | 8 |
| lb/in.$^3$ | 0.289 | 0.289 |
| Melting range, ° F. | 2550-2650 | 2500-2550 |
| ° C. | 1400-1455 | 1370-1400 |
| Modulus of Elasticity, 10$^3$ ksi | 28-29 | 28 |
| Poisson's Ratio | 0.29 | |
| CTE, linear 250° C. | 9.89 μin/in-° F. | 9 μin/in-° F. |

Insulation materials useful in systems and methods of this disclosure should be durable, fire resistant, weatherproof, and of acceptable R-value depending on the heating or cooling duty, or capable of being modified or combined with other materials into a composite insulation material to acceptable R-values. Insultherm® Inc., assignee of the present application, uses a variety of insulation materials, depending on the type of project and insulation requirements, striving for optimum performance and to keep costs to a minimum. A variety of insulation products may be used, including aerogels, fiberglass (the glass fiber itself bonded together with thermosetting resin into a low density, lofty web, not glass fiber reinforced plastic), the thermoset foamed resin known under the trade designation POLYISOFOAM, mineral wool, and the foamed glass product known under the trade designation FOAMGLAS®. These materials are discussed here briefly.

"Aerogel" is a generic word for a synthetic porous ultralight material derived from a gel, in which the liquid component of the gel has been replaced with a gas. The result is a solid with extremely low density and low thermal conductivity. Aerogels may be based on alumina, chromia, tin dioxide, or carbon (such as aerographite and aerographene). The term "aerogel" does not have a designated material with set chemical formula but the term is used to group all the material with a certain geometric structure. Useful aerogels include those known under the trade designations PYROGEL® XT-E, PYROGEL® XT-F, and CRYOGEL® Z, available commercially from Aspen Aerogels °, Inc., Northborough, Mass. (U.S.A.) which manufactures flexible, durable industrial insulation products that meet the most demanding requirements and span service temperatures ranging from −460° F. (−270° C.) to 1200° F. (650° C.).

Fiberglass insulation is manufactured from inorganic glass fibers bonded together with thermosetting resin in to a lofty mat. Fiberglass insulation can be used in plain or faced form. Faced fiberglass insulation is designed for systems that operate below ambient temperatures where vapor barrier protection is required. Fiberglass is available in a variety of densities for use on systems which operate up to 450° F. (232° C.). For faced products, surface temperature should not exceed 150° F. (66° C.). It can be readily cut with an ordinary knife and secured utilizing mechanical fasteners and/or adhesives.

Mineral wool insulation is made of inorganic fibers derived from rock, such as basalt, a volcanic rock, with a thermosetting resin binder. Advanced manufacturing technology ensures consistent product quality, with high fiber density and low shot content, for excellent performance in high temperature thermal control and fire resistance applications. Mineral wool provides excellent thermal insulation performance for mechanical, power and process systems operating from sub-ambient to 1200° F. (650° C.). Good thermal conductivity values help maximize control of heat loss, contributing to reduced operating costs and greater energy savings.

The cellular glass insulation known under the trade designation FOAMGLAS®, available from Pittsburgh Corning Corporation, Pittsburgh, Pa., U.S.A., is another insulation product that may be used in insulation systems of the present disclosure. This product comprises millions of sealed glass cells, is lightweight, rigid, and manufactured in block form, then fabricated into a wide range of shapes and sizes. The material exhibits constant insulating efficiency, is noncombustible, non-absorbent, impermeable to water and water vapor, and corrosion/chemical resistant. According to the manufacturer, this product can be certified to conform to the requirements of ASTM C552 (Standard Specification for Cellular Glass Thermal Insulation (Grade 6)).

Composite insulation materials may be used in insulation systems of the present disclosure. Composite insulation is the combination of any of the insulation products mentioned herein to create a custom insulation panel. Due to height and weight of the panel, temperature of the pressure vessel or storage vessel to be insulated, and thermal conservation, specific insulation properties are required. The edition of a single layer of polyiso material to a fiberglass or mineral wool panel adds rigidity, strength, prevents "oil canning", and maintains non-combustible requirements.

The metal outer shell or jacket, combined with the standing seams, C-channels, and cover strip as described herein, provides a weatherproof, durable maintenance-free insulation/fire protection system. The cable support matrix described herein features horizontal cables that are easily applied circumferentially around the pressure vessel or storage vessel, eliminating external bands.

One type of insulation jacketing that may be used in the panel system is stucco embossed mill finished or polyester coated aluminum, particularly the 0.024 inch (0.06 cm) and 0.032 inch (0.08 cm) thicknesses. A variety of thickness, widths, and colors are available depending on customer specifications. Panels may range in width from 1 ft. to 3 ft., or from 1.5 ft. to 2 ft., and may be customized to fit the pressure vessel height. Panels using this jacketing material meet the requirements of ASTM B-209 3105-H14 (Standard Specification for Aluminum and Aluminum-Alloy Sheet and Plate). Another type of insulation jacketing that may be used in the panel system for pressure vessels not operating at sphere temperatures is GALVALUME®, a 55% aluminum-zinc alloy coated sheet steel product that is ideally suited for most types of insulation panels. A variety of thickness, widths, and colors are available depending on customer specifications. Panels may range in width from 1 ft. to 3 ft., or from 1.5 ft. to 2 ft., and may be customized to fit the pressure vessel height. Panels using this jacketing material meet the requirements of ASTM 792.

Stainless steel is presently the most common jacketing used in the panel system for spheres and spheres (spherical pressure vessels). It is recommended for application in which the tank or vessel will be housing a highly caustic or corrosive material. It can be stucco embossed or smooth finish, and comes in a variety of thickness and widths. Custom paint colors can be applied to meet customer specifications. Panels using this jacketing material meet the requirements of ASTM A480 (Standard Specification for General Requirements for Flat-Rolled Stainless and Heat-Resisting Steel Plate, Sheet, and Strip).

From the foregoing detailed description of specific embodiments, it should be apparent that patentable apparatus, combinations, and methods have been described. Although specific embodiments of the disclosure have been described herein in some detail, this has been done solely for the purposes of describing various features and aspects of the apparatus, combinations, and methods, and is not intended to be limiting with respect to their scope. Systems and methods of the disclosure may be used during the storage of chemicals, oil, gas, asphalt, brewery, and food products. It is contemplated that various substitutions, alterations, and/or modifications, including but not limited to those implementation variations which may have been suggested herein, may be made to the described embodiments without departing from the scope of the appended claims.

What is claimed is:

1. An insulated sphere comprising:

a) a sphere having a sphere wall, a sphere wall exterior surface, and a sphere radius of curvature;

b) an insulation system installed on the sphere wall exterior surface, the insulation system comprising:

i) an equatorial support comprising:

A) a metal generally horizontal equatorial support bar having upper and lower metal rods attached to a plurality of metal tabs that are in turn attached to respective upper and lower sides of the bar, the equatorial support bar having a radius of curvature greater than the radius of curvature of the sphere;

B) the equatorial support bar further comprising a plurality of metal clips extending away from a major surface of the bar, the clips each having one or more passages configured to accept one or more additional metal rods;

C) one or more bolting plates securing ends of the equatorial support bar, or corresponding ends of segments of same;

ii) one or more insulation layers held to the sphere wall exterior surface, each layer held by a plurality of arcuate laterally spaced metal bands each having first and second ends, the first ends secured to one of the metal rods, the second ends secured to top or bottom sphere collars;

iii) a cable support matrix comprising a plurality of horizontal metal tensioned cables and a plurality of arcuate laterally spaced metal straps, each of the metal straps having a plurality of arcuate latitudinally spaced loops facing away from the sphere wall external surface, each arcuate loop defining a passage therethrough, the arcuate loops on each of the metal straps corresponding in number to the plurality of cables, each of the plurality of metal cables routed through horizontally aligned arcuate loops of the arcuate laterally spaced metal straps; and iv) a plurality of insulation panels secured to the cables of the cable support matrix by a plurality of fasteners, each insulation panel comprising insulation material and an exterior metal jacket, each insulation panel positioned between horizontally adjacent insulation panels configured with standing seams.

2. The insulated sphere of claim 1 wherein the plurality of metal clips extend perpendicularly away from the equatorial support bar.

3. The insulated sphere of claim 2 wherein the plurality of metal clips extending perpendicularly away from the equatorial support bar each have same thickness and are metal plates comprising a base welded to the exterior surface of the equatorial support bar, the metal plates devoid of passages other than the one or more passages for the one or more additional rods.

4. The insulated sphere of claim 1 comprising an equatorial cover strip flashing and a C-channel flashing, a long end of the C-channel flashing inserted under a bottom edge of the equatorial cover strip flashing, then pop riveted, creating a seal, the C-channel flashing installed between the horizontally adjacent insulation panels and further riveted thereto and to the standing seam.

5. The insulated sphere of claim 1 wherein the plurality of horizontal metal tensioned cables are not attached to the plurality of arcuate laterally spaced metal straps of the cable support matrix in any way.

6. The insulated sphere of claim 1 wherein each of the plurality of insulation panels have dunnage attached thereto to prevent cable telegraphing.

7. The insulated sphere of claim 1 wherein the insulation material is selected from the group consisting of aerogel, glass fiber, mineral fiber, cellular glass foam, polyisocyanurate foam, and combinations and composites thereof.

8. The insulated sphere of claim 1 wherein the exterior metal jacket is selected from the group consisting of aluminum sheet, stainless steel sheet, sheets of alloys of zinc and aluminum, and combinations and composites thereof.

9. The insulated sphere of claim 1 wherein an upper portion of each of the plurality of insulation panels secured to an upper hemisphere of the sphere are secured to a top center cap using a plurality of threaded members, and a lower portion of each of the plurality of insulation panels secured to a lower hemisphere of the sphere are secured to a bottom center cap using a plurality of threaded members.

10. The insulated sphere of claim 1 wherein each of the plurality of horizontal metal tensioned cables is selected from the group consisting of stainless steel and a solid-solution alloy having a melting point range of 2370 to 2460° F. (1300 to 1350° C.) consisting essentially of from 28 to 34 percent copper, a minimum of 63 percent nickel, a maximum of 2.0 percent manganese, a maximum of 2.5 percent iron, a maximum of 0.3 percent carbon, a maximum of 0.024 percent sulfur, and a maximum of 0.5 percent silicon.

11. The insulated sphere of claim 10 wherein each of the plurality of horizontal metal tensioned cables is tensioned to at least 100 lb near first and second poles of the sphere, and up to a tension of about 500 lb for cables near an equator of the sphere.

12. A sphere insulation system or kit comprising:

i) an equatorial support comprising:

A) a metal equatorial support bar configured to have upper and lower metal rods attached thereto, the metal rods configured to be attached to a plurality of metal tabs that are in turn configured to be attached to respective upper and lower sides of the bar, the equatorial support bar configured to have a radius of curvature greater than a radius of curvature of a sphere to be insulated, the sphere having an external surface;

B) the equatorial support bar further configured to have a plurality of metal clips extending away from a major surface of the bar, the clips each having one or more passages configured to accept one or more additional metal rods;

C) one or more bolting plates configured to secure ends of the equatorial support bar, or corresponding ends of segments of same;

ii) one or more insulation layers and a plurality of metal bands each having first and second ends, the insulation layers configured to be held to an external surface of the sphere, each layer configured to be held by some of the plurality of metal bands arcuately shaped and laterally spaced about the sphere, the first ends secured to one of the metal rods, the second ends secured to top or bottom sphere collars;

iii) a cable support matrix comprising a plurality of metal cables and a plurality of metal straps, the metal cables and metal straps configured to be arcuately shaped about the sphere, each metal strap configured to have a plurality of spaced apart arcuate loops extending away from a first major surface of each metal strap, the metal straps figured to be positioned so that the arcuate loops extend away from the sphere external surface, each arcuate loop defining a passage therethrough configured to accept one of the metal cables, the arcuate loops on each of the metal straps corresponding in number at least to the plurality of cables, each of the plurality of metal cables configured to be routed through horizontally aligned passages in the arcuate loops of the arcuately shaped laterally spaced metal straps; and iv) a plurality of insulation panels configured to be secured to the plurality of metal cables by a plurality of fasteners, each insulation panel comprising insulation material and an exterior metal jacket, each insulation panel configured to be positioned between horizontally adjacent insulation panels configured with standing seams.

13. The sphere insulation system or kit of claim 12 wherein the plurality of metal clips extend perpendicularly away from the equatorial support bar.

14. The sphere insulation system or kit of claim 13 wherein the plurality of metal clips extending perpendicularly away from the equatorial support bar and each have the same thickness and are metal plates comprising a base welded to the exterior surface of the equatorial support bar, the metal plates devoid of passages other than the one or more passages for the one or more additional rods.

15. The sphere insulation system or kit of claim 12 comprising an equatorial cover strip flashing and a C-channel flashing, a long end of the C-channel flashing adapted to be inserted under a bottom edge of the equatorial cover strip flashing, then pop riveted, creating a seal, the C-channel flashing configured to be installed between the horizontally adjacent insulation panels and further riveted thereto and to the standing seam.

16. The sphere insulation system or kit of claim 12 wherein the insulation material is selected from the group consisting of aerogel, glass fiber, mineral fiber, cellular glass foam, polyisocyanurate foam, and combinations and composites thereof.

17. The sphere insulation system of kit of claim 12 wherein the exterior metal jacket is selected from the group consisting of aluminum sheet, stainless steel sheet, sheets of alloys of zinc and aluminum, and combinations and composites thereof.

18. The sphere insulation system or kit of claim 12 wherein each of the plurality of horizontal metal tensioned cables is selected from the group consisting of stainless steel and a solid-solution alloy having a melting point range of 2370 to 2460° F. (1300 to 1350° C.) consisting essentially of from 28 to 34 percent copper, a minimum of 63 percent nickel, a maximum of 2.0 percent manganese, a maximum of 2.5 percent iron, a maximum of 0.3 percent carbon, a maximum of 0.024 percent sulfur, and a maximum of 0.5 percent silicon.

19. A method of insulating a spherical pressure vessel, the spherical pressure vessel having a spherical pressure vessel wall, a spherical pressure vessel wall exterior surface, and a spherical pressure vessel radius of curvature, the method comprising:

(a) attaching an equatorial support to the spherical pressure vessel wall exterior surface, the equatorial support comprising:

i) a metal generally horizontal equatorial support bar having upper and lower metal rods attached to a plurality of metal tabs that are in turn attached to respective upper and lower sides of the bar, the equatorial support bar having a radius of curvature greater than the radius of curvature of the spherical pressure vessel;

ii) the equatorial support bar further comprising a plurality of metal clips extending away from a major surface of the bar, the clips each having one or more passages configured to accept one or more additional metal rods;

iii) one or more bolting plates securing ends of the equatorial support bar, or corresponding ends of segments of same;

b) attaching one or more insulation layers to the spherical pressure vessel wall by i) placing insulation material against the spherical pressure vessel wall exterior surface;

ii) laterally spacing a plurality of arcuately shaped metal bands about the spherical pressure vessel, each having first and second ends, iii) attaching the first end of each metal band to one of the metal rods, and iv) attaching the second end of each metal band to top or bottom sphere collars;

c) installing a cable support matrix over the one or more insulation layers of step (b), by i) placing a plurality of arcuate laterally spaced metal straps over the one or more insulation layers, the metal straps having a plurality of spaced apart arcuate loops on external surfaces of the straps facing away from the spherical pressure vessel wall external surface, ii) selecting a plurality of cables comprising metal selected from the group consisting of stainless steel and a solid-solution alloy having a melting point range of 2370 to 2460° F. (1300 to 1350° C.) consisting essentially of from 28 to 34 percent copper, a minimum of 63 percent nickel, a maximum of 2.0 percent manganese, a maximum of 2.5 percent iron, a maximum of 0.3 percent carbon, a maximum of 0.024 percent sulfur, and a maximum of 0.5 percent silicon, iii) routing each of the plurality of cables comprising metal through horizontally aligned passages in horizontally aligned arcuate loops, the arcuate loops on each strap corresponding in number to the plurality of cables comprising metal; and iv) tensioning the cables comprising metal; and d) securing a plurality of insulation panels to the cables comprising metal of the cable support matrix by use of a plurality of fasteners, each of the plurality of insulation panels comprising insulation material and an exterior metal jacket, each of the plurality of insulation panels positioned between horizontally adjacent insulation panels with standing seams.

* * * * *